US007000984B1

(12) United States Patent
Ward

(10) Patent No.: US 7,000,984 B1
(45) Date of Patent: Feb. 21, 2006

(54) BEACH TOWEL CAR SEAT COVER

(76) Inventor: Lisa Ward, 1201 Musket Ct., Belcamp, MD (US) 21017

( * ) Notice: Subject to any disclaimer, the term of this patent is extended or adjusted under 35 U.S.C. 154(b) by 0 days.

(21) Appl. No.: 11/004,541

(22) Filed: Dec. 3, 2004

(51) Int. Cl.
*A47C 31/11* (2006.01)

(52) U.S. Cl. ..... 297/228.12; 297/219.1; 297/229; 297/188.2

(58) Field of Classification Search ..... 297/188.06, 297/188.2, 219.12, 228.12, 229, 228.1; 5/484, 5/485, 500, 502
See application file for complete search history.

(56) References Cited

U.S. PATENT DOCUMENTS

| | | | | |
|---|---|---|---|---|
| 2,027,947 | A | 1/1936 | Wittcoff | |
| 2,202,065 | A * | 5/1940 | Peebles | 297/229 |
| 2,791,268 | A * | 5/1957 | Mendelsohn | 297/255 |
| 4,396,227 | A | 8/1983 | Neilson | |
| 4,694,511 | A | 9/1987 | Estes et al. | |
| 4,723,814 | A | 2/1988 | Hunt | |
| 4,725,094 | A * | 2/1988 | Greer | 297/229 |
| 4,824,168 | A * | 4/1989 | Makoski | 297/229 |
| 4,877,288 | A * | 10/1989 | Lee | 297/229 |
| 4,891,454 | A * | 1/1990 | Perdelwitz et al. | 297/219.12 |
| 4,892,353 | A * | 1/1990 | Goddard | 297/188.2 |
| 5,005,901 | A | 4/1991 | Hinde | |
| 5,326,152 | A * | 7/1994 | Baron | 297/188.04 |
| 5,620,229 | A * | 4/1997 | Ledford | 297/229 |
| D387,939 | S * | 12/1997 | Tedesco et al. | D6/610 |
| 5,806,925 | A * | 9/1998 | Hanley | 297/229 |
| 5,911,476 | A | 6/1999 | Horn | |
| 5,957,528 | A | 9/1999 | Campbell | |
| 6,050,639 | A | 4/2000 | Horn | |
| 6,067,777 | A | 5/2000 | Stoll | |
| 6,338,527 | B1 | 1/2002 | Toyota et al. | |
| 6,648,410 | B1 * | 11/2003 | Sparks | 297/228.12 |
| 6,655,735 | B1 | 12/2003 | Learning | |

FOREIGN PATENT DOCUMENTS

| | | |
|---|---|---|
| CA | 2.255.388 | 6/2000 |

* cited by examiner

*Primary Examiner*—Peter R. Brown
(74) *Attorney, Agent, or Firm*—Michael I. Kroll

(57) ABSTRACT

Apparatus 10 for a seat cover 16 that will protect the underlying seat 12 from moisture and dirt having a base layer comprising a moisture impermeable material 28 and a top layer of an absorbent material 24 with strategically placed straps 14 providing means for securing the seat cover to a seat. A pocket 18 is provided for storing wet items.

6 Claims, 9 Drawing Sheets

BEACH TOWEL CAR SEAT COVER

BACKGROUND OF THE INVENTION

1. Field of the Invention

The present invention relates generally to covers and, more specifically, to a seat cover that will protect the underlying seat from moisture and dirt having a base layer comprising a moisture impermeable material and a top layer of an absorbent material with strategically placed straps providing means for securing the seat cover to a seat.

2. Description of the Prior Art

There are other seat covers designed for motor vehicles. Typical of these is U.S. Pat. No. 2,027,947 issued to Wittcoff on Jan. 14, 1936.

Another patent was issued to Nielson on Aug. 2, 1983 as U.S. Pat. No. 4,396,227. Yet another U.S. Pat. No. 4,694,511 was issued to Estes, et al. on Sep. 22, 1987 and still yet another was issued on Feb. 9, 1988 to Hunt as U.S. Pat. No. 4,723,814.

Another patent was issued to Hinde on Apr. 9, 1991 as U.S. Pat. No. 5,005,901. Yet another U.S. Pat. No. 5,911,476 was issued to Horn on Jun. 15, 1999. Another was issued to Campbell on Sep. 28, 1999 as U.S. Pat. No. 5,957,528 and still yet another was issued on Apr. 18, 2000 to Horn as U.S. Pat. No. 6,050,639.

Another patent was issued to Stoll on May 30, 2000 as U.S. Pat. No. 6,067,777. Yet another U.S. Pat. No. 6,338,527 was issued to Toyota, et al. on Jan. 15, 2002. Another was issued to Learning on Dec. 2, 2003 as U.S. Pat. No. 6,655,735 and still yet another was issued on Jun. 9, 2000 to Melone as Canadian Patent No. CA2,255,388.

U.S. Pat. No. 2,027,947

Inventor: Edward Wittcoff

Issued: Jan. 14, 1936

A seat cover comprising a section of flexible and pliable material having approximately the same area as the area of the surface to which it is to be applied, a flexible and pliable frame enclosing and attached to the margin of said section, a strip extending longitudinally of and attached to that side of said section that is concealed when the cover is in use, transverse strips attached to said concealed side of the ends of said section and to the ends of said longitudinal strip, a flexible and pliable section attached to each end of said first section and to said transverse strips and said frame and adapted to extend across the ends of the seat member to which said first section is applied, and a transverse stiffener attached to the outer end of each of said last named sections and preventing the same from folding.

U.S. Pat. No. 4,396,227

Inventor: William N. Neilson

Issued: Aug. 2, 1983

A car seat cover comprised of sheep skin with wool attached thereto and including fitting means making it suitable for universal fitting to a variety of different sizes of car seats and including appropriately located sleeves and fixed attachments for cords resiliently connected thereto to provide holding for the cover on a car seat.

U.S. Pat. No. 4,694,511

Inventor: Donna L. Estes

Issued: Sep. 22, 1987

Disclosed is a versatile article of manufacture for use by persons engaged in recreational activities such as those associated with the beach. The article, typically made of fabric, has a tubular upper half attached to a depending panel equipped with ties or fasteners. The upper end of the tubular portion has a central opening between a pair of corner openings rendering the article selectively usable as a garment for a person wearing a bathing suit, as a protective cover for a vehicle seat while occupied by bathers en route to and from the beach, and as a cover for a beach chair. The tubular portion of the article may be imprinted with designs on both the back and the front sides and worn with either design facing forwardly.

U.S. Pat. No. 4,723,814

Inventor: Evelyn E. Hunt

Issued: Feb. 9, 1988

A vehicle seat protection device, for protecting a seat having a back, consists of a loose seat cover attached to an elongate member. The elongate member has fixing means for fixing the member in proximity to the upper edge of the seat back. The elongate member also has means for detachably connecting the seat cover thereto.

U.S. Pat. No. 5,005,901

Inventor: Brian Hinde

Issued: Apr. 9, 1991

A removable cover for a seat, particularly an automobile or other vehicle seat, the seat having a seat portion and a back portion, is made of a pliable material and has a back covering portion, a seat covering portion and, formed on an exterior surface of the cover, a pocket. The back covering portion, seat covering portion and pocket are integral, and the back covering portion and the seat covering portion are receivable in the pocket when the cover is not in use.

U.S. Pat. No. 5,911,476

Inventor: Joachim Horn

Issued: Jun. 15, 1999

A seat cover is shown for protecting a motor vehicle seat the seat cover being made from an at least double-layered piece of plastic, in particular for the single, use in car workshops, comprising a front layer extending over and protecting the seating and the backrest surface of the seat and a rear layer connected with the front layer by transverse welding and together with the front layer forming a backrest pocket for the reception of at least a part of the backrest and forming a seat pocket for the reception of at least a part of the seat cushion. The rear layer forming part of the seat pocket comprises a protecting strip in U-form formed by a cutout and surrounding the sides of the seat cushion, and the part of the front layer adapted to the gap between the backrest and the seat cushion comprises at both sides a protecting element each to cover the link regions of the seat.

U.S. Pat. No. 5,957,528

Inventor: Kelly K. Campbell

Issued: Sep. 28, 1999

A seat cover preferably made of washable fabric has flexible foam attachment members and a flexible foam flap and is removably installed on a vehicle's seat. The basic structure of the seat cover consists of a seat portion and a back portion with a flap portion longitudinally extending between the seat and back portions. The flap portion has one or more deformable pad members affixed to the flap portion for insertion of the flap portion into the seat between the back and the seat cushion of the seat. Two or more strap members extend transversely from the opposite corners of the seat cover and have at least one deformable pad affixed to the end of the strap member for insertion of the end of the strap member between the seat and the car body.

U.S. Pat. No. 6,050,639

Inventor: Joachim Horn

Issued: Apr. 18, 2000

A temporary seat cover for protecting a motor vehicle seat is made of a majority of layers of plastic film. The motor vehicle seat includes a seat cushion, a backrest, and a gap being located between the seat cushion and the backrest. The seat cover includes a front layer made of plastic film and extending along the seat cushion and the backrest. A rear layer made of plastic film is connected to the front layer by transverse welding seams. A backrest pocket receives at least a portion of the backrest. The backrest pocket is formed by the front layer and the rear layer. A seat pocket for the receives at least a portion of the seat cushion. The seat pocket is formed by the front layer and the rear layer. A strip-shaped extension is connected to one of the layers and it is designed and arranged to be moved through the gap. A glue film is arranged on the strip-shaped extension and it is covered by a removable cover strip. The cover strip is removed prior to connecting the strip-shaped extension to a portion of the cover seat or directly to the motor vehicle seat. A sealing effect preventing undesired manipulation of the seat cover and the seat is attained.

U.S. Pat. No. 6,067,777

Inventor: Dieter Stoll

Issued: May 30, 2000

A protective wrapping for a vehicle seat includes a separate protective wrapping for the backrest cushion and a separate protective wrapping for the seat cushion. The backrest cushion wrapping includes a protective bag that loosely encloses the backrest cushion from above on all sides the backrest cushion to the level of the seat surface. By means of a closing tongue that reaches around the backrest underside from the front to the rear, the protective bag is fixed on the backrest cushion. The seat cushion wrapping includes a protective hood that encloses the seat cushion from above on all sides. The sides are gathered in a circular manner, particularly shrunk, below the seat cushion, so that the seat cushion wrapping rests under pre-stress laterally on the seat cushion.

U.S. Pat. No. 6,338,527

Inventor: David K. Toyota, et al.

Issued: Jan. 15, 2000

A headrest secured seat cover for vehicles having side-impact airbags mounted within the sides of the seat. The cover comprises a bottom and middle portion attachable to the seat cushion. A top portion of the seat cover is attachable to the seat headrest. In order to attach the seat cover to the headrest, the seat cover includes at least one elastic strap attached to the top portion of the cover and configured to attach the top portion of the cover to mounting bars of the headrest. The seat cover further includes a stiffening member disposed about a periphery of the top portion of the seat cover. The stiffening member supports the top portion of the seat cover such that the seat cover will be contourable to the shape of the vehicle seat and remain in place. Since the seat cover is attached to the headrest, the sides of the seat are unobstructed for proper airbag inflation.

U.S. Pat. No. 6,655,735

Inventor: Thomas W. Learning

Issued: Dec. 2, 2003

A non-absorbing protective seat cover having a seat portion and a back portion, comprising a water-impermeable and gas-permeable layer laminated to a non-absorbent non-woven layer, whereby the non-absorbing protective cover resists absorption of liquid contaminates from the user, hydrophobically repels liquid contaminants introduced thereto and protects the vehicle seat from damage.

Canadian Patent Number CA2,255,388

Inventor: Francis Melone

Issued: Jun. 9, 2000

A cover for the seat back and head rest of a motor vehicle having bucket seats is designed with the look and feel of a typical hooded sweatshirt. Features such as a "hood", "hand warmer" type pockets and a stretchable waistband enhance the illusion. The cover uses typical sweatshirt materials which have a variety of desirable characteristics. or example, a cotton facing with cotton fleece lining is hypo allergenic and has the desirable combination of stretch and absorbency. The cover also provides a venue for the display of popular logos, such as sports team names or college names in an automobile. The cover is easy to remove and install. Moreover, a "hand warmer" pocket is provided in the lumbar region in the seat back front, which may be stuffed with soft material to enhance comfort and lumbar support. Other pockets may be provided on a back side for maps or other items which may be conveniently stored within.

While these coverings may be suitable for the purposes for which they were designed, they would not be as suitable for the purposes of the present invention, as hereinafter described.

SUMMARY OF THE PRESENT INVENTION

The present invention discloses a seat cover that will protect the underlying seat from moisture and dirt having a base layer comprising a moisture impermeable material and a top layer of an absorbent material with strategically placed straps providing means for securing the seat cover to a seat. A pocket is provided for storing wet items.

A primary object of the present invention is to provide a seat cover that will protect the underlying seat from moisture and dirt.

Another object of the present invention is to provide a seat cover having a base layer comprising a moisture impermeable material.

Yet another object of the present invention is to provide a seat cover having a top layer of an absorbent material.

Still yet another object of the present invention is to provide a seat cover with strategically placed straps providing means for securing the seat cover to a seat.

Additional objects of the present invention will appear as the description proceeds.

The present invention overcomes the shortcomings of the prior art by providing a seat cover that will protect the underlying seat from moisture and dirt having a base layer comprising a moisture impermeable material and a top layer of an absorbent material with strategically placed straps providing means for securing the seat cover to a seat.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
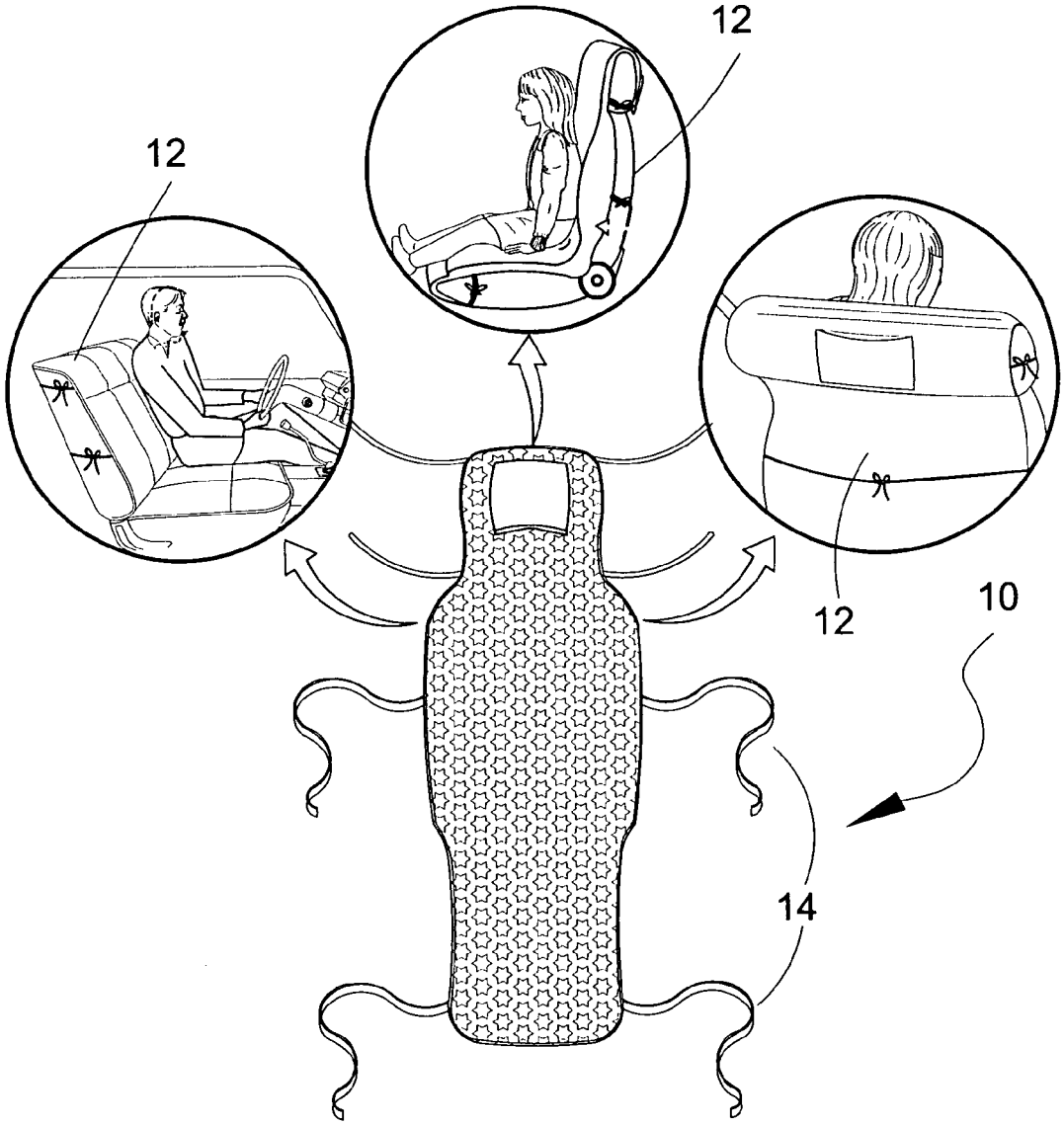
FIG. 1 is an illustrative view of the present invention in use.

With regard to reference numerals used, the following numbering is used throughout the drawings.

10 present invention
12 seat
14 straps
16 cover
18 pocket
20 user
22 bathing suit
24 absorbent layer
26 decorative design
28 waterproof layer
30 fabric
32 tie
34 front surface
36 rear surface
38 top end
40 front edge

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a beach towel car seat cover comprising a moisture impermeable material layer and an absorbent material layer wherein the seat cover prevents moisture from wicking around the edge of the seat cover. The device 10 is secured to a seat 12 by means of a plurality of tie straps 14. A pocket is provided for storage of wet items.

Figure 2:
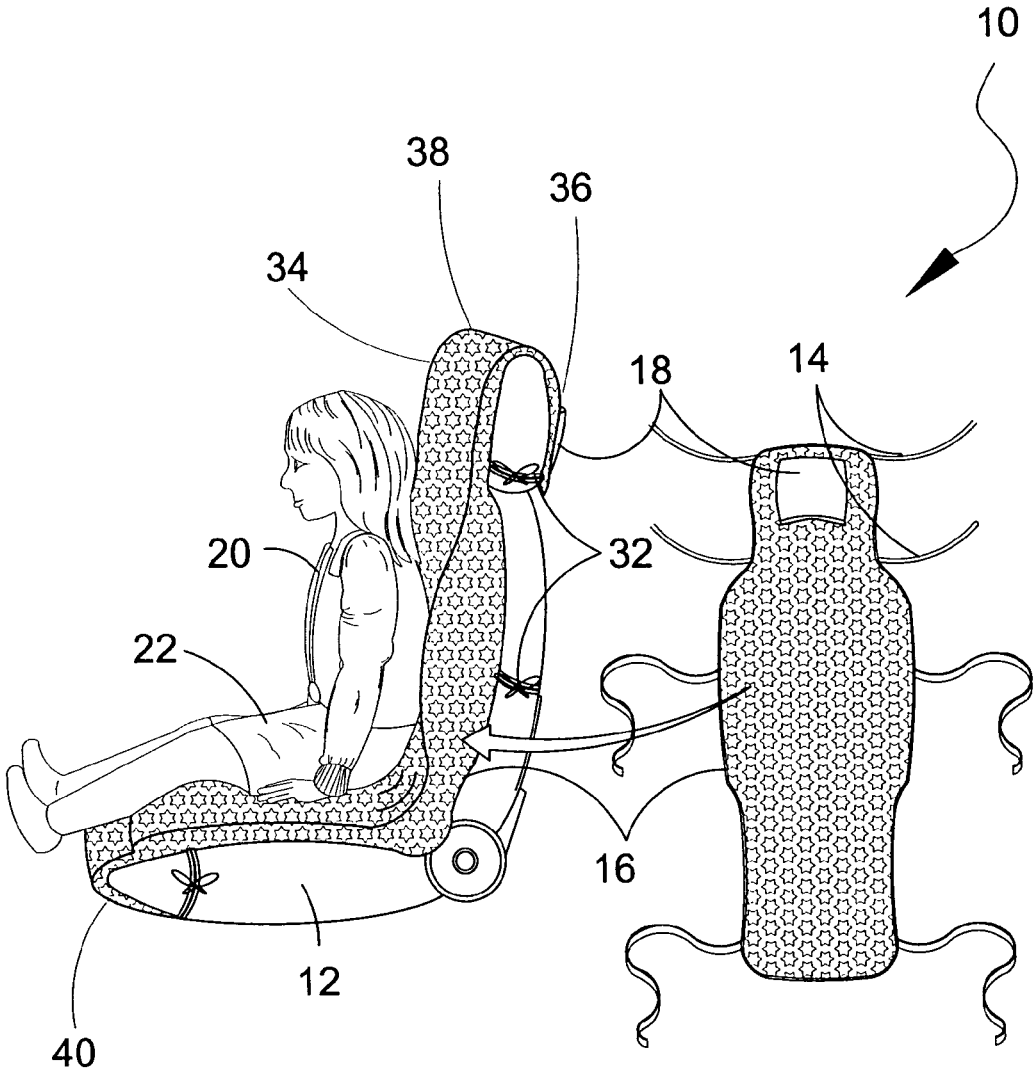
FIG. 2 is an illustrative view of the present invention in use on a bucket type seat.

Turning to FIG. 2, shown therein is an illustrative view of the present invention 10 in use on a bucket type seat 12. Shown is the present invention 10 disclosing a beach towel car seat cover 16 comprising a moisture impermeable material layer and an absorbent material layer wherein the seat cover prevents moisture from wicking around the edge of the seat cover. The device 10 is secured around the edges of and to a seat 12 by means of a plurality of ties 32 of the ends of multiple spaced apart straps 14 on the edges of the cover 16. A pocket 18 is provided for storage of wet items. Also shown are a user 20 wearing a wet bathing suit 22. Seat 12 has a seat back with front and rear surfaces 34, 36 and a top end 38 and the seating surface of the seat has a front edge 40. Cover 16 may have a substantially rectangular shape.

Figure 3:
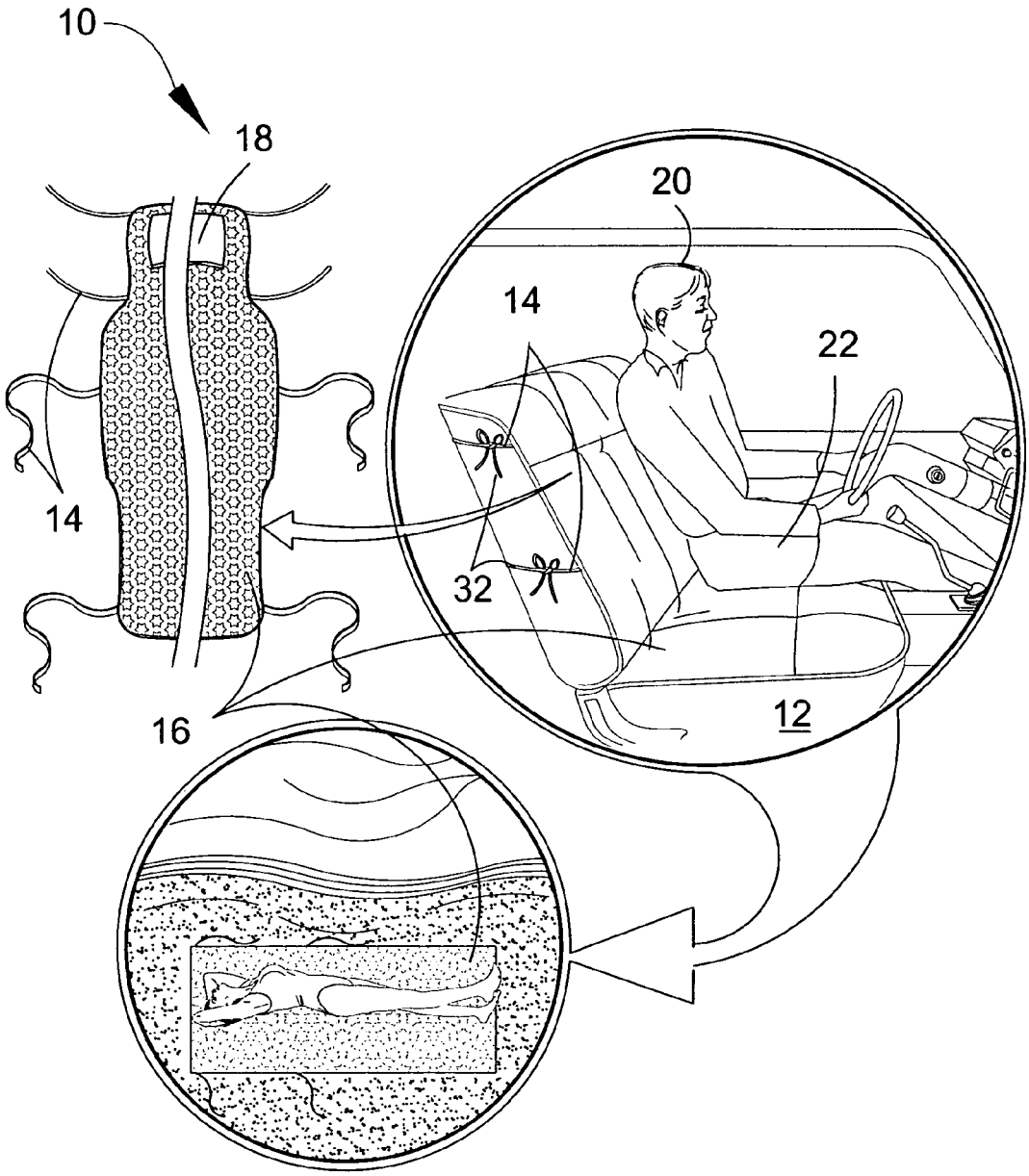
FIG. 3 is an illustrative view of the present invention in use on a bench type seat.

Turning to FIG. 3, shown therein 3 is an illustrative view of the present invention 10 in use on a bench type seat 12. Shown is the present invention disclosing a beach towel car seat cover 16 comprising a moisture impermeable material layer and an absorbent material layer wherein the seat cover prevents moisture from wicking around the edge of the seat cover. The device 10 is secured to a seat 12 by means of a plurality of tie 32 straps 14. A pocket 18 is provided for storage of wet items. Also shown is a user 20 with a wet bathing suit 22.

Figure 4:
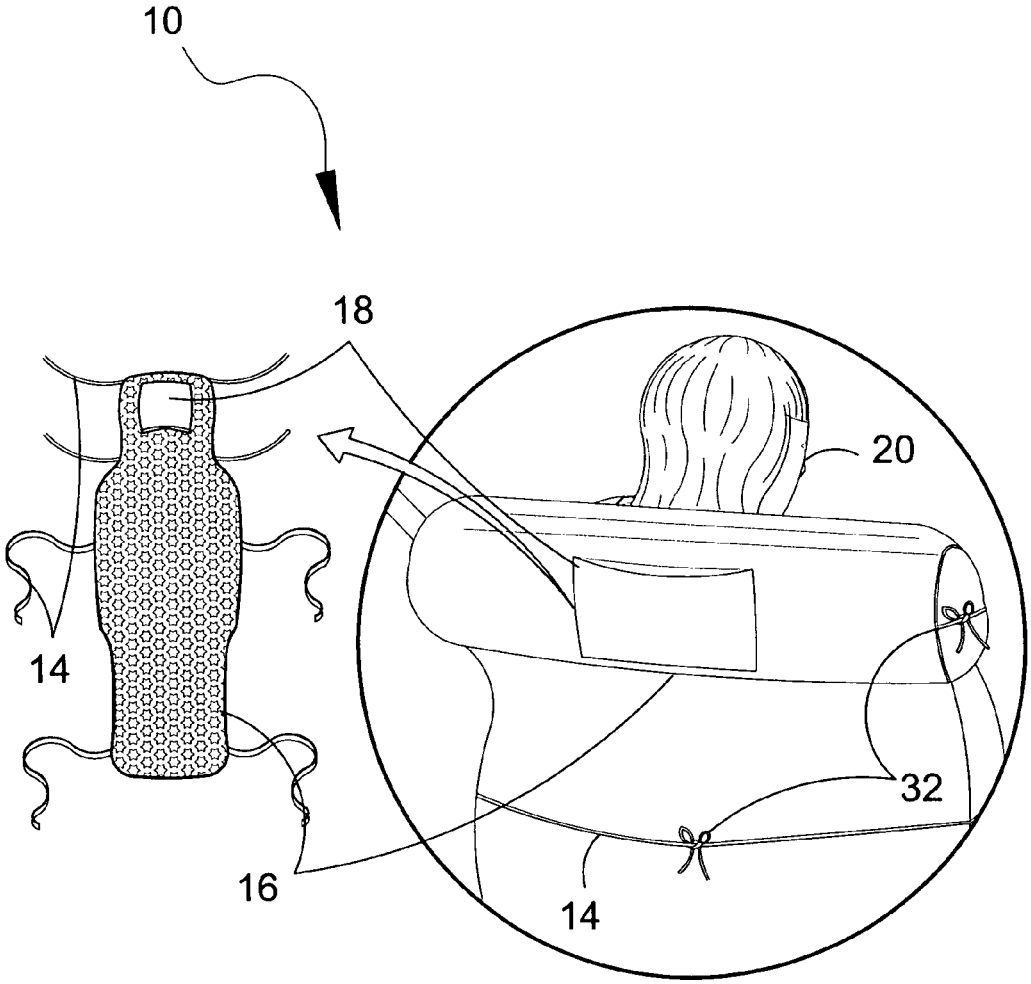
FIG. 4 is an illustrative view of the rear portion of the present invention.

Turning to FIG. 4, shown therein is an illustrative view of the rear portion of the present invention 10. Shown is the present invention 10 disclosing a beach towel car seat cover 16 comprising a moisture impermeable material layer and an absorbent material layer, wherein the seat cover 16 prevents moisture from wicking around the edge of the seat cover. The device 10 is secured to a seat by means of a plurality of tie 32 straps 14. A pocket 18 is provided for storage of wet items. Also shown is user 20.

Figure 5:
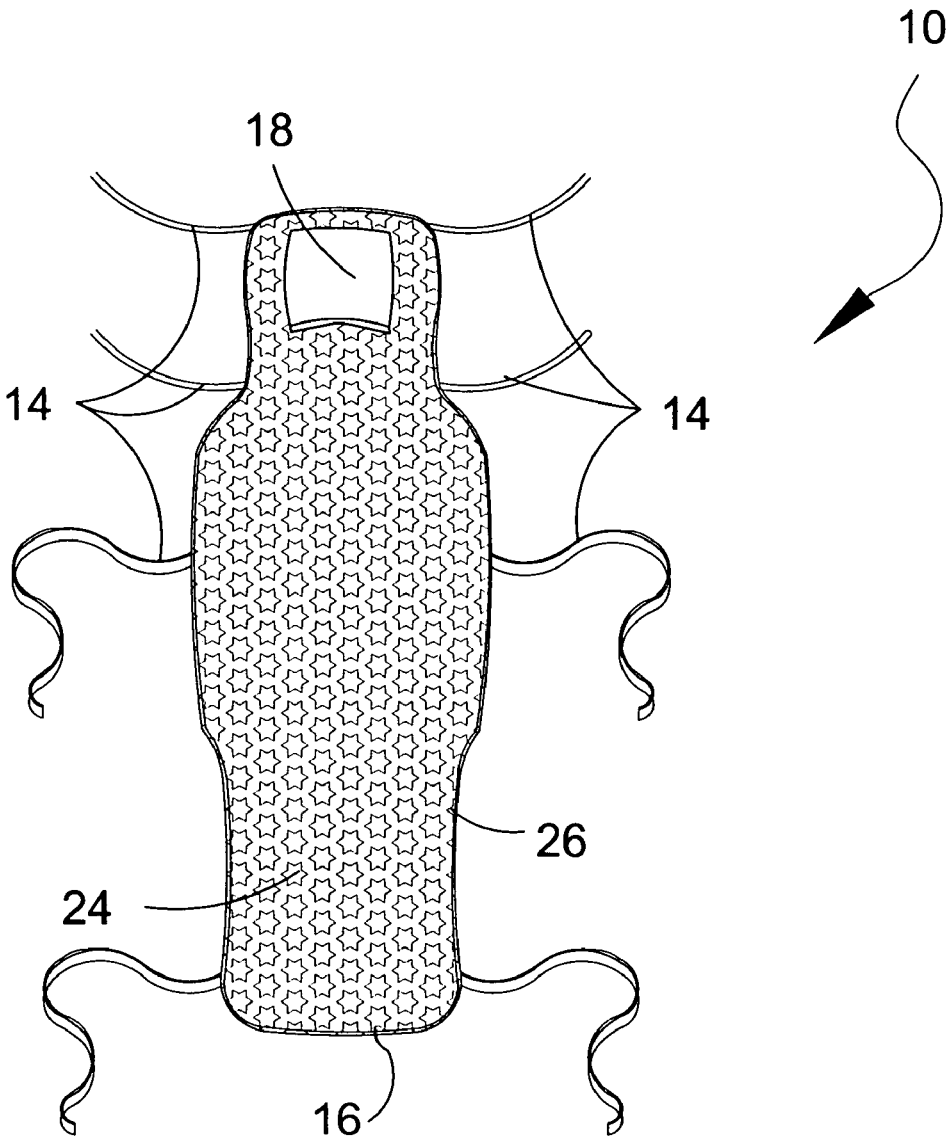
FIG. 5 is a frontal view of the present invention.

Turning to FIG. 5, shown therein is a frontal view of the present invention 10. Shown is a frontal view of the present invention 10 disclosing a beach towel car seat cover 16 comprising a moisture impermeable material layer and an absorbent material layer 24 wherein the seat cover 16 prevents moisture from wicking around the edge of the seat cover. The device 10 can be made in decorative designs 26 and is secured to a seat by means of a plurality of tie straps 14. A pocket 18 is provided for storage of wet items.

Figure 6:
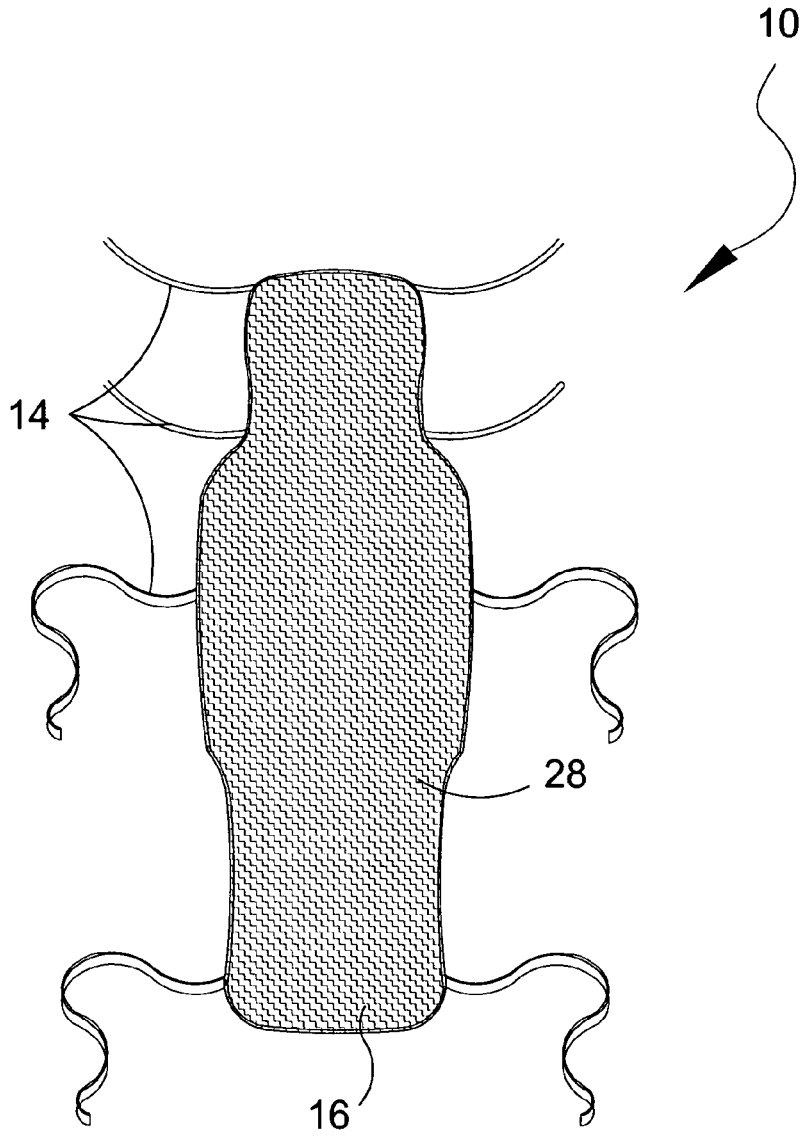
FIG. 6 is a rear view of the present invention.

Turning to FIG. 6, shown therein is a rear view of the present invention 10. Shown is a rear view of the present invention 10 disclosing a beach towel car seat cover 16 comprising a moisture impermeable material layer 28 which may comprise vinyl and an absorbent material layer, wherein the seat cover 16 prevents moisture from wicking around the edge of the seat cover. The device 10 is secured to a seat by means of a plurality of tie straps 14. A pocket is provided for storage of wet items.

Figure 7:
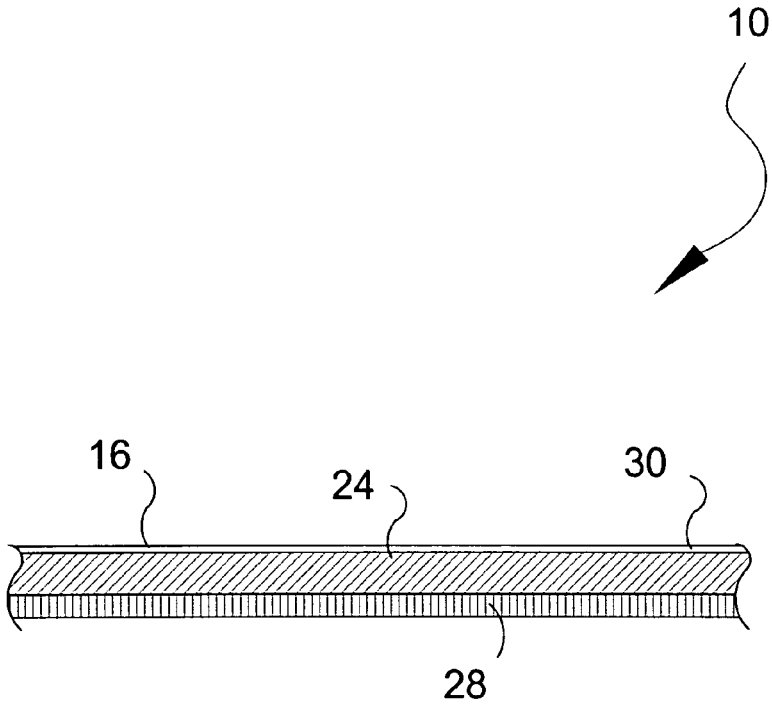
FIG. 7 is a sectional view of the present invention.

Turning to FIG. 7, shown therein is a sectional view of the present invention 10. Shown is a sectional view of the present invention 10 disclosing a beach towel car seat cover 16 front or top fabric 30 comprising a bottom moisture impermeable material layer 28 and an absorbent material layer 24, wherein the seat cover prevents moisture from wicking around the edge of the seat cover. The device 10 is secured to a seat by means of a plurality of tie straps. A pocket is provided for storage of wet items.

Figure 8:
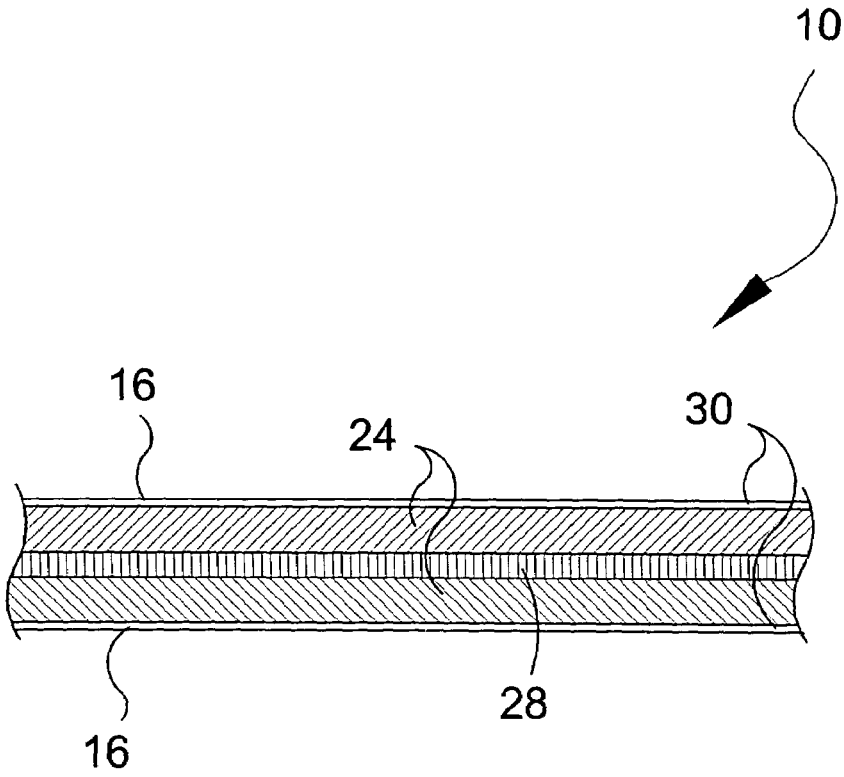
FIG. 8 is a perspective view of the present invention.

Turning to FIG. 8, shown therein is a perspective view of the present invention 10. Shown is a perspective view of the present invention 10 disclosing a beach towel car seat cover 16 made of fabric 30 comprising a moisture impermeable material layer 28 and an absorbent material layer 24, wherein the seat cover prevents moisture from wicking around the edge of the seat cover. The device 10 is secured to a seat by means of a plurality of tie straps. A pocket is provided for storage of wet items.

Figure 9:
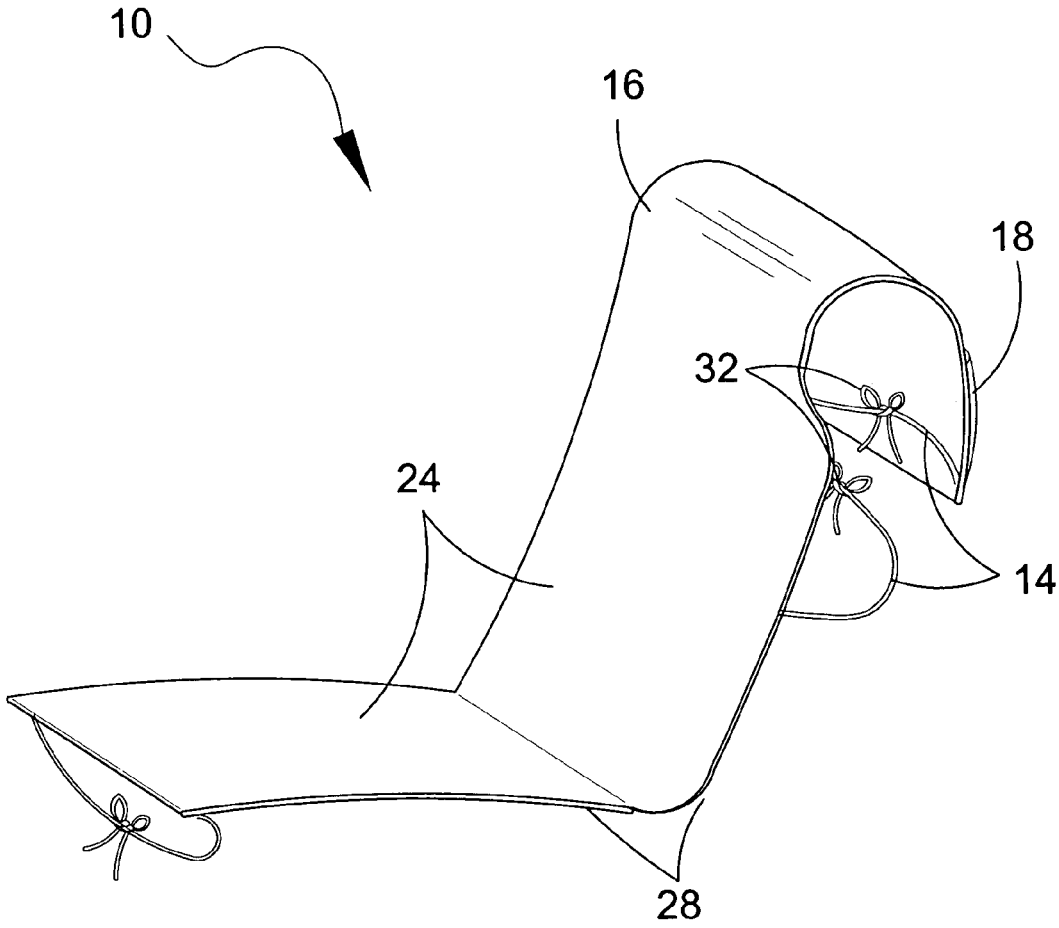
FIG. 9 is a perspective view of the present invention.

Turning to FIG. 9, shown therein is a perspective view of the present invention 10. Shown is a perspective view of the present invention 10 disclosing a beach towel car seat cover 16 comprising a moisture impermeable material layer 28 and an absorbent material layer 24 wherein the seat cover prevents moisture from wicking around the edge of the seat cover. The device 10 is secured to a seat by means of a plurality of tie straps 14 which are tied at 32. A pocket 10 is provided for storage of wet items.

I claim:

1. An apparatus for providing a removable, temporary protective cover for a car seat, the car seat having a seat back with front and rear surfaces and an upper end, the car seat further having a seating surface on which a rider can be seated, the seating surface having a front edge, comprising:

a) a protective cover complementarily sized to fit on the seat, said cover being elongated having first and second ends, first and second edges, and top and bottom surfaces so that said bottom of said cover is disposed contiguous to the car seat;

b) said cover having a first absorbent layer for absorbing moisture, said first absorbent layer having a top and bottom surface;

c) said cover having a moisture impermeable layer for preventing moisture from reaching the car seat, said impermeable layer having a top and bottom surface, wherein said bottom surface of said first absorbent layer is disposed contiguous to said top surface of said impermeable layer;

d) said cover having a second absorbent layer for absorbing moisture, said second absorbent layer having a top and bottom surface, wherein said top surface of said second absorbent layer is disposed contiguous to said bottom surface of said impermeable layer;

e) said cover having a first fabric layer disposed on said top surface of said first absorbent layer to provide a first decorative layer;

f) said cover having a second fabric layer disposed on said bottom surface of said second absorbent layer to provide a second decorative layer;

g) a plurality of straps being attached in a spaced apart relationship to said first and second edges of said cover to permit the cover to be placed on the car seat and attached to the car seat using the straps; and, h) a pocket being disposed on said first end of said top of said cover for receiving articles therein.

2. The apparatus of claim 1, wherein said cover can be placed on the car seat so that said first end of said cover extends over the upper end of the seat back so that said pocket is disposed contiguous to said rear surface of the seat back.

3. The apparatus of claim 2, wherein said cover is attached to the car seat by extending a first strap over an edge of the car seat and then extending a second strap over an opposite edge of the car seat and then tying said first and second straps together.

4. The apparatus of claim 3, wherein said first and second fabric layer are made of decorative material.

5. The apparatus of claim 4, wherein said cover is also usable as a beach towel.

6. The apparatus of claim 5, wherein said cover is rectangular shaped.

* * * * *